US005806168A

United States Patent [19]

Wurst et al.

[11] Patent Number: 5,806,168

[45] Date of Patent: Sep. 15, 1998

[54] TOOL FOR THE CONTEMPORARY CRIMPING OF A PLURALITY OF INSULATED WIRES IN AN ELECTRICAL CONNECTOR

[75] Inventors: Wolfgang Wurst, Hamburg; Eckhard Wolter, Duermentingen, both of Germany

[73] Assignee: Minnesota Mining and Manufacturing Company, St. Paul, Minn.

[21] Appl. No.: 850,289

[22] Filed: May 5, 1997

Related U.S. Application Data

[63] Continuation of Ser. No. 356,165, Dec. 18, 1994, abandoned.

[30] Foreign Application Priority Data

Apr. 14, 1993 [DE] Germany ..... 9305607

[51] Int. Cl.[6] ..... H01R 43/01

[52] U.S. Cl. ..... 29/566.4; 29/751; 29/755

[58] Field of Search ..... 29/749, 751, 755, 29/566.4, 566.3

[56] References Cited

U.S. PATENT DOCUMENTS

| | | | |
|---|---|---|---|
| 3,354,692 | 11/1967 | Morris | 72/402 |
| 3,885,287 | 5/1975 | Long . | |
| 4,001,931 | 1/1977 | McKee | 29/749 |
| 4,044,451 | 8/1977 | Bunnell | 29/751 |
| 4,318,215 | 3/1982 | Holt | 29/749 |
| 4,615,111 | 10/1986 | Rommel | 29/749 |
| 4,816,705 | 3/1989 | Ohba . | |
| 4,892,015 | 1/1990 | Beetz . | |
| 5,042,286 | 8/1991 | Wiebe | 29/751 |
| 5,435,167 | 7/1995 | Holliday | 29/751 |

FOREIGN PATENT DOCUMENTS

| | | |
|---|---|---|
| 139368 | 5/1985 | European Pat. Off. . |
| 309871 | 4/1989 | European Pat. Off. . |
| 2515171 | 10/1984 | Germany . |
| 3704904 | 8/1988 | Germany . |

*Primary Examiner*—Daniel C. Crane
*Attorney, Agent, or Firm*—Gerald F. Chernivec

[57] ABSTRACT

A tool (10) for the termination of insulated wires in electrical connectors having different heights, which tool has a mechanism affording adjustment of the spacing between a pressing body (50), accommodated by a splice head, and a retaining body for the connector. The adjustment in height between the bodies is afforded by step adjustment and by an intermediate member (56, 58) affording smaller pitches, and the tool has an attachment mechanism for releasably attaching the tool to the retaining body.

2 Claims, 5 Drawing Sheets

TOOL FOR THE CONTEMPORARY CRIMPING OF A PLURALITY OF INSULATED WIRES IN AN ELECTRICAL CONNECTOR

This is continuation of application Ser. No. 08/356,165, filed Dec. 18, 1994, now abandoned, which is a 371 of PCT/US/94/03268, filed Mar. 24, 1994.

This is a continuation of application Ser. No. 08/356,165, filed Dec. 18, 1994, now abandoned, which is a 371 of PCT/U.S.94/03268, filed Mar. 24, 1994.

BACKGROUND OF THE INVENTION

1. Field of the Invention

The invention refers to a tool for the contemporary crimping of a plurality of insulated wires in an electrical connector.

2. Prior Art

Particularly in the telecommunication industry, electrical connectors have become known which are adapted to receive a multiplicity of insulated wires in order to terminate a plurality of electrical contacts. It is further known to establish the connection in that the connectors are provided with U-shaped insulation displacement contacts into which the wires are pressed. The insulation displacement contacts are located in a retaining body into which the individual wires are inserted. A pressing body or cover cooperates with the retaining body in order to press the individual wires contemporaneously into the U-shaped insulation displacement contacts.

Such connectors are for example disclosed by the German patent DE 39 20 367.

It is further known to accommodate such connectors in a splice head provided to facilitate the insertion of the wires into the connectors. Only when all wires are inserted and fixed, a pressing into the contact elements of the retaining body is carried out by means of the pressing body. Usually, this operation makes se of a corresponding pliers-like tool as for instance known from the German patent DE 25 15 171. The known tool includes legs which embrace the splice head on opposite sides and are attached thereto. A pressing member is located between the arms and can be moved by means of a manually operable lever and transmission means in order to press a plurality of wires into the retaining body which wires are also contemporarily cut. In this tool, the pressing force is built up and transmitted mechanically. From the European Patent Application EP 0 179 112 it is also known to exert the pressing force through hydraulic transmission means.

It is also known to provide the known connectors with plug contacts and plug contact strips. It is further known to stack two or more connectors one above the other. For this reason, the different combinations of connectors have different height. It is therefore necessary to consider the height of the different connectors when the wires are pressed and crimped. In case of hydraulically actuatable tools, this can be realized by a corresponding hydraulic control. Such tools, however, are relatively heavy and relatively difficult to handle. If manually operable, tools of less weight are desired, and usually each height of a connector necessitates another tool.

SUMMARY OF THE INVENTION

The invention provides for a tool wherein insulated wires can be pressed into connectors of different height.

In the tool according to the invention, the pressing member is adapted to be displaced by predetermined steps relative to the splice head independent from the transmission means. The actuation of the manual lever leads to a displacement of the pressing member relative to the splice head. This displacement, however, cannot be used for an adaptation to the height of the connector because a predetermined stroke is necessary in order to press the inserted wires fully into the contacts. At the end of such stroke, a locking means or other means are applied to avoid a further displacement of the pressing member. With a tool according to the invention, such a limitation of the stroke is also provided. By an adjustment of the position of the pressing member beforehand the stroke commences from different initial positions adapted to the actual height of the connector used at any one time.

Various structures can be conceived in order to realize a displacement of the pressing member step by step. One embodiment of the invention provides that at least an intermediate member is linked to the rear side of the pressing member rotatable about an axis. In different positions, the intermediate member coacts with a transmission lever actuated by the manual lever, with the pressing member having a different distance from the transmission lever in the individual rotational positions of the intermediate member. The intermediate member can for example be mounted on an eccentric member. The eccentric member can be actuated externally by a lever and for example effect two positions of the pressing member. According to another embodiment of the invention, the intermediate member has a plurality of recesses at the circumference thereof which may be engaged by a trunnion attached to the transmission lever, with the recesses having a different spacing from the rotation axis of the intermediate member. The number of displacement steps of the pressing member corresponds to the number of recesses. The latter embodiment is particularly suited for tools which attain an unambiguous fixed position relative to the splice head, i.e. cannot be displaced relative to the splice head.

According to another embodiment of the invention, the splice head has teeth at opposite sides, and the tool has pivotally supported levers including also a tooth which coacts with the teeth of the splice head. The pitch of the teeth can be selected such that the spacing between two adjacent teeth corresponds to the difference in the height of the two different connectors. For connector combinations between these height values, an adaptation can be carried out by a displacement of the pressing member, e.g. by the described eccentric member.

BRIEF DESCRIPTION OF THE DRAWINGS

The invention will be subsequently described by means of embodiment examples in connection with the accompanied drawings, wherein.

DETAILED DESCRIPTION OF THE DRAWINGS

Figures 1, 1A:
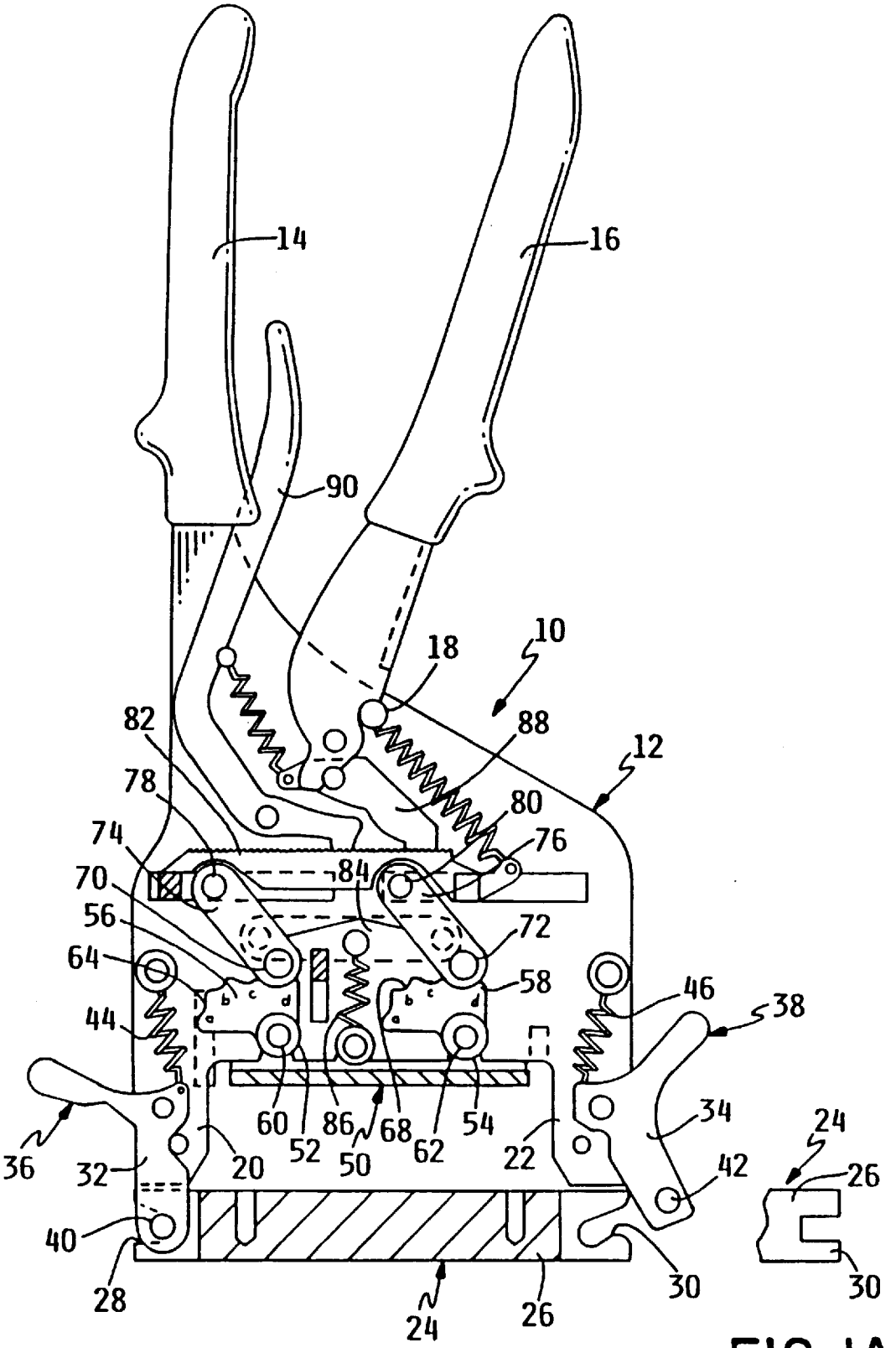
FIG. 1 is a plan view of a first embodiment of a tool according to the invention wherein the housing is partially removed.
FIG. 1A is a fragmentary detail view.

The tool 10 shown in FIG. 1 includes a housing 12 which is depicted partially opened. A first lever 14 is fixedly attached to the housing while a second actuation lever 16 is linked to housing 12 at 18. At the opposite end of the housing, two parallel spaced extensions 20, 22 are provided which cooperate with a splice head indicated at 24. An accommodation plate 26, or retaining member, of splice head 24 is shown onto which an electrical connector (not shown) can be placed. Plate 26 has recesses 28, 30 at opposite ends which are engaged by lower arms 32, 34 of levers 36, 38 by means of pins 40, 42 thereon in order to attach tool 10 to splice head 24. As separately shown in FIG. 1A, at the right side of FIG. 1, recesses 28, 30 are formed in bifurcated portions of plate 26; the pins 40, 42 thus are provided on opposite sides of lever arms 32, 34. The levers 36, 38 are pivotally supported on housing 12 and can be tilted clockwise and counter-clockwise, respectively, as indicated on the right side of FIG. 1 in order to engage and disengage with recesses 28, 30, with the levers 36, 38 biased by springs 44, 46 towards locking direction.

An elongated pressing member 50 which extends approximately parallel to accommodation plate 26 is linked to two sector-like intermediate members 56, 58 at 52,54. The intermediate member 56,58 can be rotated by a square neck 60, 62, for example by a suitable wrench so that various recesses 64, 68 at the circumference of the intermediate members 56, 58 may be engaged by trunnions 70, 72 of links 74, 76. The links 74, 76 are linked the transmission means, including a rack 82, at 78, 80 displaceably supported in housing 12 parallel to pressing member 50. The levers 74, 76 are further coupled by a connecting lever 84 which is coupled to pressing member 50 through a spring 86.

The rack 82 is moved parallel to the pressing member by a ratchet lever 88 having a toothed end linked to actuation lever 16. A spring-biased locking lever 90 also having teeth meshing with the teeth on the rack 82 in each position. By means of the described mechanism, the pressing member can be moved towards the accommodation plate 26 about a predetermined stroke length so that a connector on the accommodation plate 26 is pressed a predetermined amount in order to crimp the wires in the manner described above.

As can be seen, the individual recesses 64, 68 designated with a,b,c and d on the sector-like intermediate member, have a different spacing from rotation axis 52,54 of intermediate member 56,58. Therefore, the pressing member 50 has a different initial position when carrying out the described stroke in dependence of the recesses 64, 68 engaged by the trunnion 70, 72 of lever 74,76. In this manner, an adjustment to the height of a connector can be achieved.

In the crimping operation described the pressing member 50 makes a predetermined stroke while a limitation of the stroke for example can be achieved by stop means cooperating with rack 82. If the crimping operation is finished, stop lever 90 is actuated so that rack 82 is moved back by the spring bias in the position shown in FIG. 1. In order to remove the connector, levers 36, 38 are tilted so that the tool 10 can be released from splice head 24. Thereafter, the connector can be removed from splice head 24.

Figure 2:
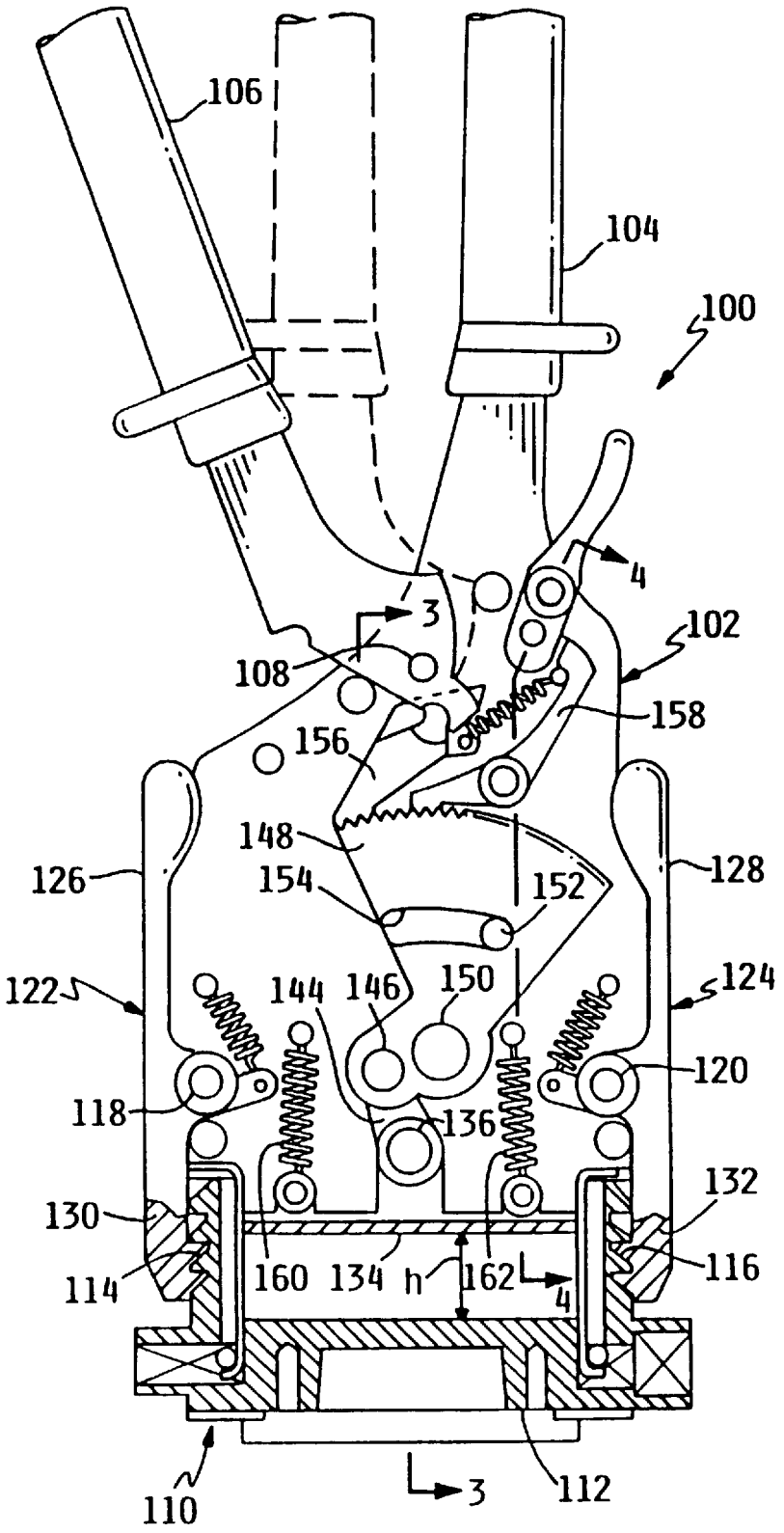
FIG. 2 is a plan view of a second embodiment of a tool according to the invention wherein also a part of the housing is removed.

The tool 100 shown in FIG. 2 includes a housing 102, an actuation lever 104 fixedly attached to housing 102 while a further actuation lever 106 is linked to housing 102 at 108. The housing 102 is depicted partially opened in order to more clearly show the transmission mechanism.

A splice head 110 has a retaining member in the form of an accommodation plate 112 for the accommodation of a connector not shown. On opposite sides of splice head 110 is a rack each having parallel teeth 114, 116. Levers 122, 124 are linked to opposite sides of housing 102 at 118, 120. One arm of the levers 122, 124 defines a handle 126, 128 while the other arm 130, 132 is also provided with teeth cooperating with the teeth 114, 116 of splice head 110. In accordance with the pitch of teeth 114, 116 or 130, 132, respectively, a predetermined spacing "h" of the pressing member 134 from the upper side of accommodation plate 112 can be adjusted.

Figure 3:
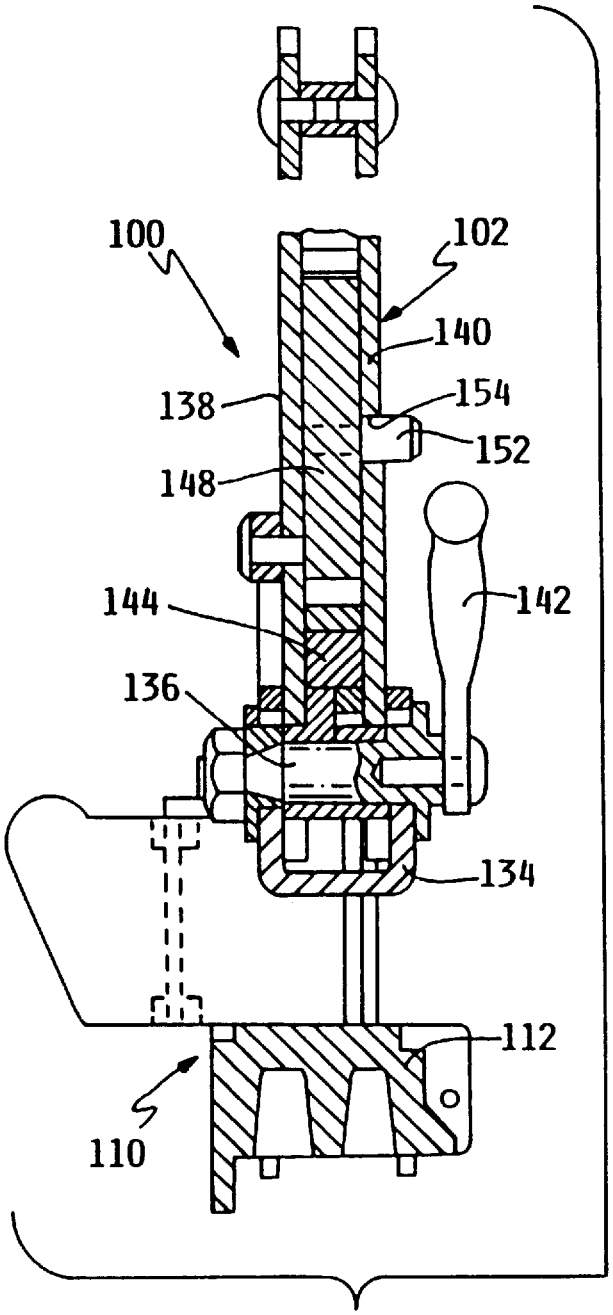
FIG. 3 is a cross section through the tool of FIG. 2 taken along line 3—3.
Figure 4:
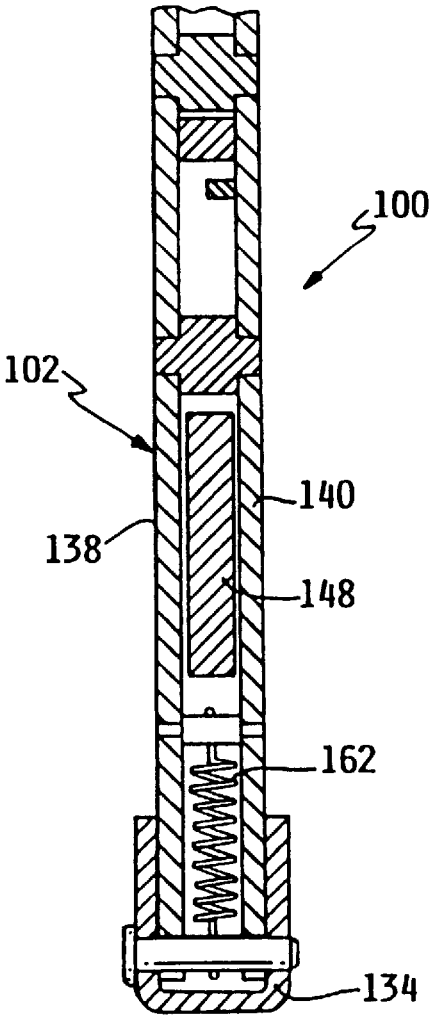
FIG. 4 is a cross section through the tool of FIG. 2 taken along line 4—4.

As can be seen in FIGS. 3 and 4, the pressing member 134 is U-shaped in cross section and linked to housing 102 by means of an eccentric bolt 136. By the way, the housing includes two opposite plates 138, 140. On one end, the eccentric bolt 136 is connected with a hand lever 142 so that spacing "h" can be changed by a tilting of lever 142. The eccentric bolt 136 has an extension 144 linked to a gear segment 148 at 146 (see FIG. 2), with the gear segment 148 rotatably supported by housing 102 at 150. It includes a pinion 152 cooperating with a slot 154 of housing 102 indicated by dashed lines.

The transmission means for pressing the member 134 against the plate 112 includes a ratchet lever 156 which is linked to actuation lever 106 so that an actuation of lever 106 leads to a rotation of gear segment 148 counter-clockwise. A spring-biased locking lever 158 secures the position of the gear segment 148. Upon rotation of gear segment 148, pressing member 134 is moved downwardly in order to exert a force on a connector on accommodation plate 112. The stroke length of pressing member 134 is limited by the length of the arc of the gear segment 148.

Figure 5:
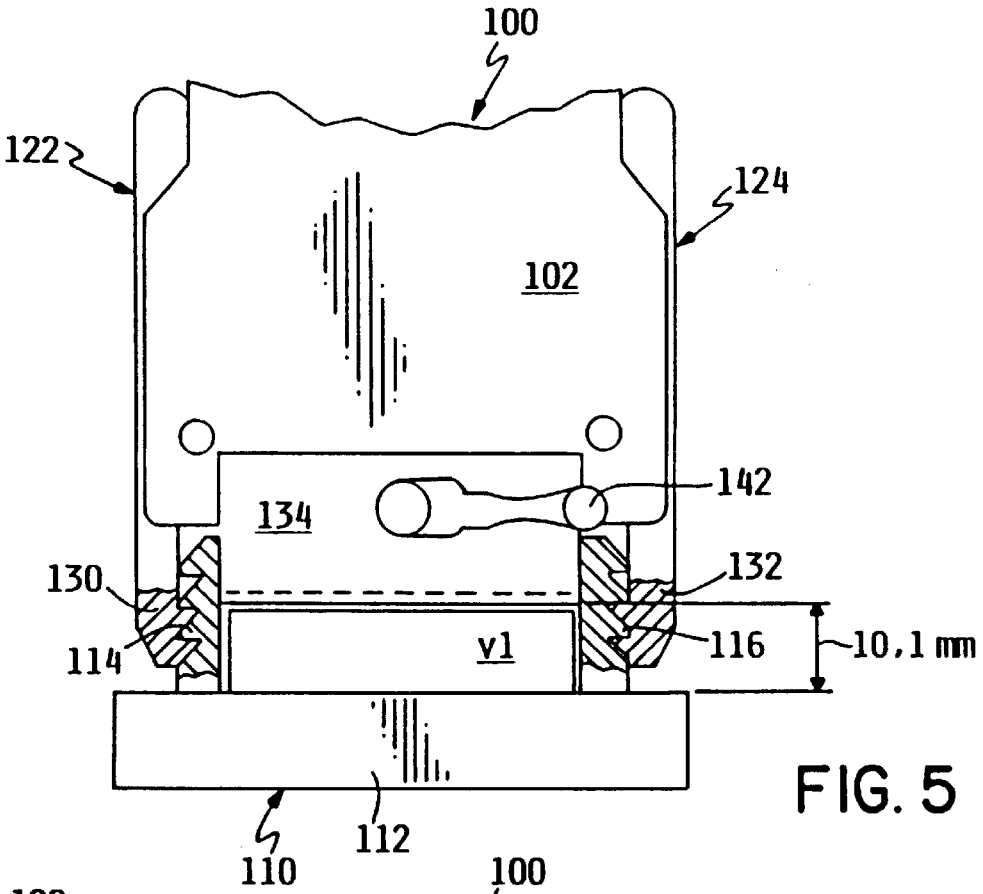
FIG. 5 is a side view of the tool of FIG. 2 and of a connector with a first height.
Figure 6:
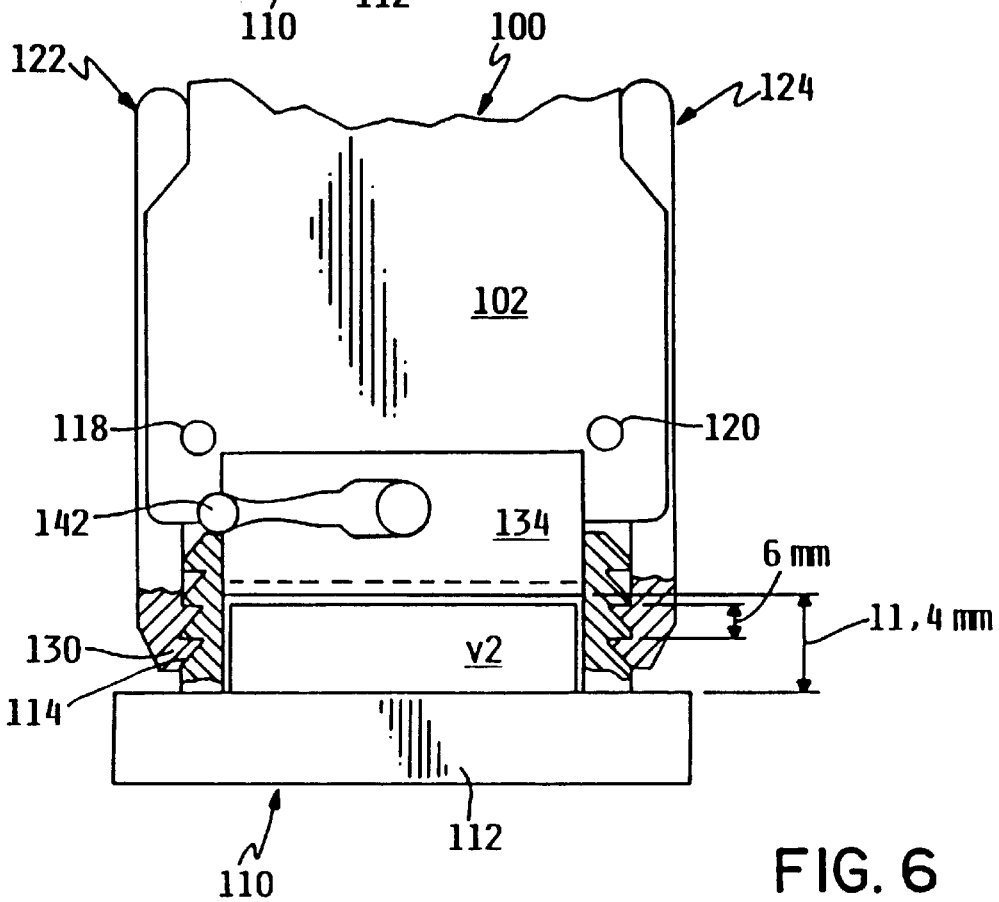
FIG. 6 is an illustration similar to FIG. 5, however, with a connector having a second height.
Figure 7:
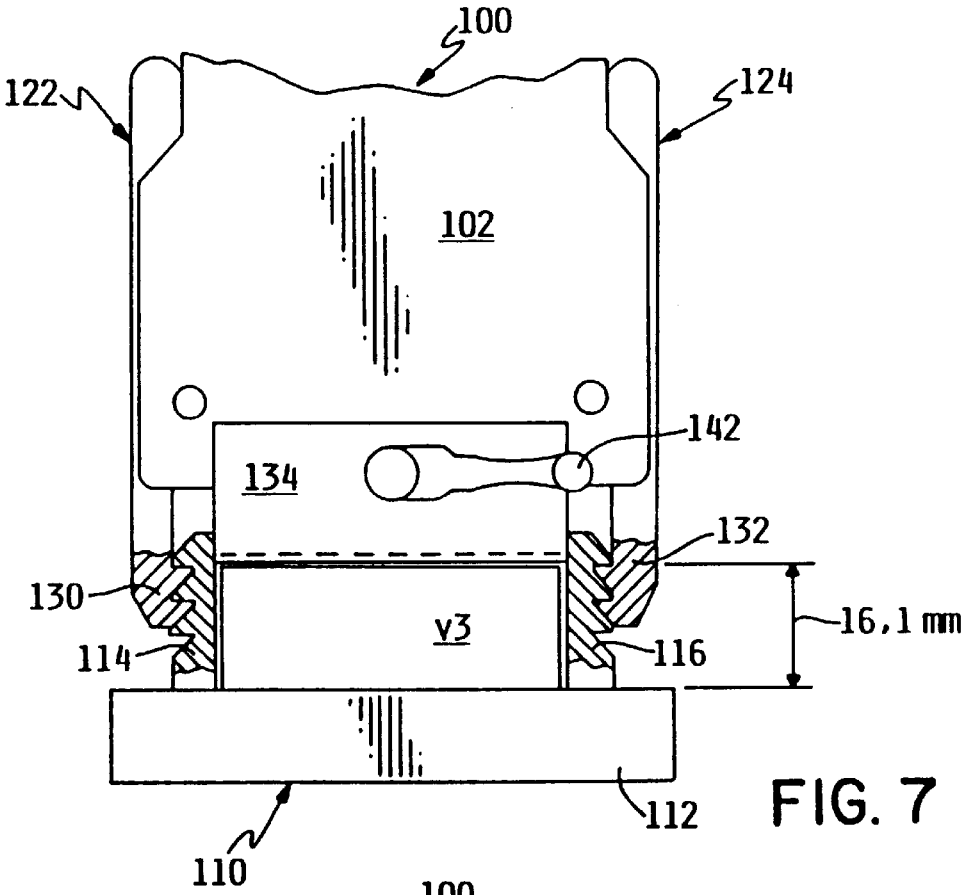
FIG. 7 is an illustration similar to FIG. 5, however, with a connector having a third height.
Figure 8:
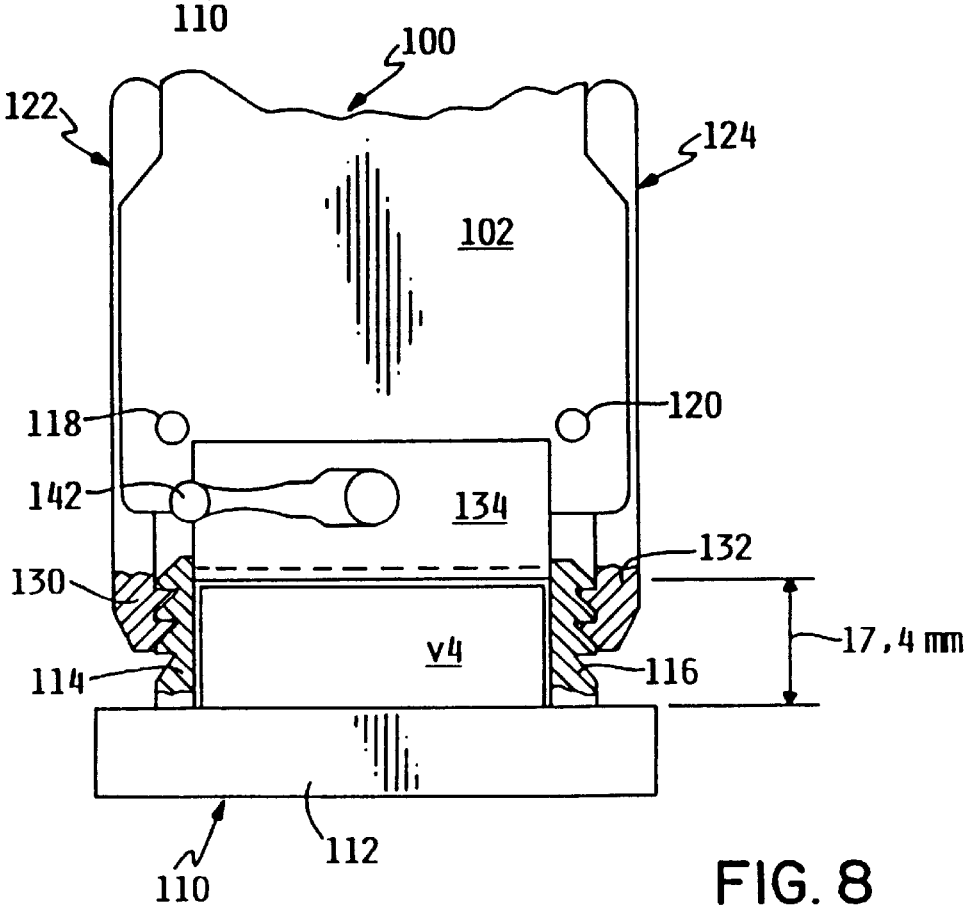
FIG. 8 is an illustration similar to FIG. 5, however, with a connector having a fourth height.

In FIGS. 5 to 8, a tool 100 is shown in connection with connectors v1 to v4 of different height accommodated by a splice head 110. The connectors v1 and v2 of FIGS. 6 and 7 have a difference in height of for example 6 mm. The difference in height between the connectors v3 and v4 of FIGS. 7 and 8 amount for example to 1,3 mm. As can be seen in FIGS. 5 and 6 or 7 and 8, respectively, a tilting of hand lever 142 and thus a rotation of the eccentric bolt 136 about 180° results in a displacement of the pressing member 134 about 1,3 mm. The spacings between pressing member 134 and plate 112 in FIGS. 5 and 6 are 10,1 and 11,4 mm, respectively, and regarding FIGS. 7 and 8 16,1 and 17,4 mm. In the embodiment of FIGS. 5 and 6, the toothing of levers 122, 124 engages the lowest area of toothing 114, 116 of splice head 110. In the embodiment of FIGS. 7 and 8, the engagement is offset about one tooth pitch. This corresponds to a change in the spacing between pressing member 134 and plate 112 in the amount of 6 mm. If lever 142 in FIG. 7 is tilted about 180° according to FIG. 8, pressing member 134 is lowered about 1,3 mm. The lowering of pressing member starts, however from a changed position which is about 6 mm higher that of FIGS. 5 and 6.

In the manner described, connectors of four different heights can be handled by tool 100. If the toothing 114, 116 of levers 122, 124 engage the toothing of splice head 110 further upwardly, connectors with larger heights can be dealt with also.

It should be mentioned that pressing member 134 is biased by springs 160, 162 towards the eccentric bolt 136 in order to give the pressing member 134 a defined vibration-free position.

We claim:

1. A tool for crimping a plurality of insulated wires in an electrical connector, comprising means for releasably attaching the tool to a splice head having an accommodation plate for holding the electrical connector, a pressing member for engaging the electrical connector in the splice head, and a pivotally mounted and manually operated lever that actuates a transmission means for moving the pressing member through a predetermined stroke to crimp the electrical connector in the splice head, the tool (100) characterized in that the attaching means (122, 124) includes teeth (130, 132) for engaging corresponding teeth (114, 116) of the splice head (110) such that the pressing member (134) can be positioned at a plurality of selectable distances from the accommodation plate (112), and the transmission means includes means (136, 142) for further adjusting the distance of the pressing member (134) from the accommodation plate (112).

2. The tool of claim 1 further characterized in that the means for further adjusting the pressing member (134) comprises an eccentric bolt (136) connected to a hand lever (142).

* * * * *